US010720049B2

(12) United States Patent
Khokhlov et al.

(10) Patent No.: US 10,720,049 B2
(45) Date of Patent: Jul. 21, 2020

(54) METHOD AND SYSTEM FOR GENERATING TRAFFIC INFORMATION TO BE USED IN MAP APPLICATION EXECUTED ON ELECTRONIC DEVICE

(71) Applicant: YANDEX EUROPE AG, Lucerne (CH)

(72) Inventors: Mikhail Aleksandrovich Khokhlov, Dolgoprudniy (RU); Arseny Vitalyevich Povolotsky, Moscow (RU)

(73) Assignee: YANDEX EUROPE AG, Lucerne (CH)

( * ) Notice: Subject to any disclaimer, the term of this patent is extended or adjusted under 35 U.S.C. 154(b) by 360 days.

(21) Appl. No.: 15/864,040

(22) Filed: Jan. 8, 2018

(65) Prior Publication Data

US 2018/0293883 A1 Oct. 11, 2018

(30) Foreign Application Priority Data

Apr. 5, 2017 (RU) ..... 2017111478

(51) Int. Cl.
*G08G 1/01* (2006.01)

(52) U.S. Cl.
CPC ..... *G08G 1/0112* (2013.01); *G08G 1/0125* (2013.01); *G08G 1/0141* (2013.01)

(58) Field of Classification Search
CPC .. G08G 1/0112; G08G 1/0125; G08G 1/0141; G08G 1/01
See application file for complete search history.

(56) References Cited

U.S. PATENT DOCUMENTS 7,765,066 B2 * 7/2010 Braeuchle ..... B62D 15/025 701/301
9,928,542 B2 * 3/2018 Argue ..... G06Q 30/0639
(Continued)

FOREIGN PATENT DOCUMENTS

RU 2406265 C2 12/2010
RU 2010128546 A 1/2012
(Continued)

OTHER PUBLICATIONS

Search Report with regard to the counterpart RU Application No. 2017111478 completed Apr. 26, 2018.
(Continued)

*Primary Examiner* — Frederick M Brushaber
(74) *Attorney, Agent, or Firm* — BCF LLP

(57) ABSTRACT

There is disclosed a computer-implemented method for evaluating traffic conditions, the method executable on a server. The method comprises receiving device movement data indicative of moving patterns of the at least some of the plurality of user devices. The method further comprises analyzing the device movement data by: selecting a specific road segment; retrieving at least a first movement pattern associated with a first user travelling the specific road segment and a second movement pattern associated with a second user travelling the specific road segment; and comparing the first movement pattern and the second movement pattern. Responsive to the first movement pattern and the second movement pattern being indicative of there being a disconnect between the first user and the second user entering and existing the specific road segment and proceeding to a same sequential road segment, the method comprises incrementing an overtaking score associated with the second user.

18 Claims, 6 Drawing Sheets

(56) References Cited

U.S. PATENT DOCUMENTS

| | | | | |
|---|---|---|---|---|
| 2002/0072963 | A1* | 6/2002 | Jonge | G07B 15/063 705/13 |
| 2005/0228588 | A1* | 10/2005 | Braeuchle | B60W 30/12 701/301 |
| 2008/0170502 | A1* | 7/2008 | Benton | H04L 67/125 370/235 |
| 2010/0109908 | A1* | 5/2010 | Miura | G08G 1/096741 340/905 |
| 2011/0015850 | A1* | 1/2011 | Tange | B62D 15/025 701/116 |
| 2011/0313740 | A1* | 12/2011 | Ikeda | G05B 17/02 703/2 |
| 2012/0290182 | A1* | 11/2012 | Cooper | B61L 27/0027 701/70 |
| 2012/0290185 | A1* | 11/2012 | Cooper | B61L 27/0027 701/93 |
| 2014/0149028 | A1 | 5/2014 | Chapman et al. | |
| 2014/0163848 | A1 | 6/2014 | Tamir et al. | |
| 2018/0293883 | A1* | 10/2018 | Khokhlov | G08G 1/0125 |

FOREIGN PATENT DOCUMENTS

| | | | |
|---|---|---|---|
| RU | 132232 | U1 | 9/2013 |
| WO | 2015170289 | A1 | 11/2015 |

OTHER PUBLICATIONS

English Abstract for RU2010128546 retrieved on Espacenet on May 31, 2018.
English Abstract for RU132232 retrieved on Espacenet on May 31, 2018.

* cited by examiner

METHOD AND SYSTEM FOR GENERATING TRAFFIC INFORMATION TO BE USED IN MAP APPLICATION EXECUTED ON ELECTRONIC DEVICE

CROSS-REFERENCE

The present application claims priority to Russian Patent Application No. 2017111478, entitled "Method And System For Generating Traffic Information To Be Used In Map Application Executed On Electronic Device," filed on Apr. 5, 2017, the entirety of which is incorporated herein by reference.

FIELD OF TECHNOLOGY

The present technology relates to mapping applications executed in the electronic devices and, more specifically, to methods and systems for generating traffic information to be used in the map applications executed on the electronic devices.

BACKGROUND

With recent developments in the wireless communication, use of wireless communication devices has become almost ubiquitous. These wireless devices include laptop computers, tablet computers, smart phones, as well as plethora of other wireless devices (car navigation devices, user-wearable navigation devices, and the like). Most, if not all, wireless devices are equipped with geo-position devices (for example, those using GPS technology for determining geo position of the wireless device, those using triangulation techniques, or the like).

Most of these wireless devices are further equipped with mapping and/or navigation applications (jointly referred herein below as a mapping application). A typical mapping application provides maps of various regions, for example, the user can use the mapping application to request a map of downtown of London, UK. The user can request such map by various means: by using the geo-location functionality of the wireless device (and a function known as "places near me" or a similar functionality of wireless devices), by typing in a postal code or a full address, etc.

The user can also use such mapping application to map routes between am origin position and a destination position. For example, where the wireless device is a smart phone, the user can use the mapping application to determine a driving route from a place in Brampton, Ontario, Canada to a place in Mississauga, Ontario, Canada by typing in a start address and a destination address. The mapping application will then create one or more routes (such as a fastest route, a route that avoids toll highways, a route that is associated with a shortest distance, etc.).

Some of these mapping applications are executed on wireless devices associated with user vehicles (such as portable GPS device or a GPS device built into modern passenger vehicles).

Some of these mapping applications (such as those provided by Yandex™ Maps, Yandex™ Navigator, Google™ Maps, Waze™, etc. provide an additional functionality of showing traffic information using the map interface of the mapping information.

With reference to FIG. 1, there is depicted a screenshot 100 of a mapping application, the screenshot 100 that can be shown on an example of the wireless electronic device, such as a smartphone, for example. The screenshot 100 shows a map 102, the map 102 depicting a map view of a particular geographical area having a plurality of route segments 104. The user of the electronic device may have requested route information about a route from a point A to a point B, marked on the map 102 accordingly in a dash-dotted line. There is a current position pointer 180 that depicts the current position associated with the wireless electronic device (which happens to be not on the requested route, as the user of the wireless electronic device may be planning a future route).

The map 102 further depicts traffic conditions information 106. In the depicted embodiment, the traffic conditions information 106 is overlaid over the plurality of route segments 104 to visually represent traffic conditions associated with the respective ones of the plurality of route segments 104. In the embodiments illustrated herein, the traffic conditions information 106 can be represented by a color (such as red for heavy traffic, blue for medium level traffic and green for no traffic), as well as (or instead of) a graphical representation (such as an arrow, which length depends on the associated traffic conditions).

The map further depicts a first type of auxiliary information indicator 108 and a second type of auxiliary information indicator 110. The first type of auxiliary information indicator 108 can be for example an indicator associated with accidents that occur along the plurality of route segments 104. The second type of auxiliary information indicator 110 can provide additional information about a particular point along the plurality of route segments 104. The additional information can be, for example, information about special driving conditions associated with the particular point along the plurality of route segments 104. For example, on multi-lane roads with flexible lanes (that can selectively accommodate traffic in one direction and another direction), the special driving conditions can outline when the given flexible lane is for the first direction and when the given flexible lane is for another direction.

The map 102 is further associated with the traffic congestion indicator 112. The traffic congestion indicator 112 can provide an indication of the overall traffic conditions associated with the map view (or a portion thereof) visible within the map 112. In the depicted example, the traffic congestion indicator 112 is implemented as a traffic light with a digit representing of the overall traffic conditions displayable therein—in this case, a digit between 0 and 10, 0 representing no traffic and 10 representing heavily congested traffic condition (commonly known as a "bumper to bumper" or a "parking lot" driving condition).

Generally speaking, the traffic information is representative of driving conditions along a pre-determined route. The traffic information can be representative of traffic conditions along the pre-determined route, taking into account traffic jams, accidents, road work, etc. The information about traffic jams for a segment of the pre-determined route is typically generated by calculating an average speed of drivers on that segment and comparing it to a reference speed. The average speed of drivers is typically calculated based on data collected from wireless devices associated with drivers, the wireless devices executing mapping applications.

Using an example of FIG. 2, there is depicted a portion of an actual road segment 202 (such as one that can be used to generate the map 102). The system collects movement data from wireless devices (that execute mapping applications) associated with vehicles moving along the actual road segment 202, such as a vehicle 206. The system collects information about the vehicle 206 entering and exiting a road segment 204 defined between a Point A and a Point B.

The system collects such information from a plurality of vehicles that are similar to the vehicle 206, the plurality of vehicles moving through the same road segment.

Based on the travel patterns associated with the plurality of vehicles travelling through the road segment 204 (i.e. the time it takes to travel through the road segment, the length of the road segment, etc.), the system then calculates an average speed or an average time taken to travel through the road segment 204. Typically, the system calculates the average speed by recording a time stamp associated with the vehicle 206 entering the road segment 204, a time stamp associated with the vehicle 206 leaving the road segment 204; and knowing the distance of the road segment 204, the system calculates the average speed of the vehicle 206.

The system then compares such generated information to some pre-defined thresholds to determine traffic conditions. For example, using the road segment 204 as an example, average travel time of under one minute can be considered to be "no traffic" indicator, travel time of between one minute and two minutes can be considered to be "moderate traffic" indicator, and travel time of over three minutes can be indicative of a "heavy traffic" indicator.

US 2014/149028 discloses techniques for assessing road traffic conditions in various ways based on obtained traffic-related data, such as data samples from vehicles and other mobile data sources traveling on the roads and/or from one or more other sources (such as physical sensors near to or embedded in the roads). The road traffic conditions assessment based on obtained data samples may include various filtering and/or conditioning of the data samples, and various inferences and probabilistic determinations of traffic-related characteristics of interest from the data samples. In some situations, the inferences include repeatedly determining current traffic flow characteristics and/or predicted future traffic flow characteristics for road segments of interest during time periods of interest, such as to determine average traffic speed, traffic volume and/or occupancy, and include weighting various data samples in various ways (e.g., based on a latency of the data samples and/or a source of the data samples).

US 2014/0163848 discloses a method of evaluating the driving behavior in a vehicle. The method includes determining values of a plurality of parameters of the operation of a first vehicle in a first road segment, determining values of the plurality of parameters for one or more second vehicles in a second road segment having similar properties to those of the first road segment, comparing the determined values of the first vehicle and the one or more second vehicles and providing an evaluation of the driving behavior of the first vehicle, responsive to the comparison.

SUMMARY

Embodiments of the present technology have been developed based on developers' appreciation that there exists at least one problem associated with prior art approaches to determining road conditions for displaying on the wireless devices executing the mapping applications.

Sometimes, while most of the drivers stand in a traffic jam, some drivers disobey the traffic rules and use bus, high occupancy lanes (HOL), taxi lanes, etc. to beat the traffic. These "bad" drivers overtake other drivers using inappropriate lanes, and, as their speed is generally higher than that of "normal" drivers standing or moving slowly due to the traffic jam, the bad drivers contribute to wrong calculation of average speed on the road segment and accordingly to the wrong estimation of a scores of traffic jams/overall traffic conditions.

Broadly speaking, embodiments of the present technology have been developed based on developers' appreciation that as a given car travels through its chosen route, it travels through several road segments. The server analyzes the car's movement pattern as a graph (where road segments are shoulders and the road segments edges and the nodes/edges of the graph). The main aim of the embodiments of the present technology is to identify drivers that do not follow a typical pattern (such as those drivers that frequently overtake or those drivers who are frequently overtaken).

In order to determine those drivers that do not follow the general pattern of the movement, embodiments of the present technology, for a given road segment, analyze a pair of drivers. The analysis selects those pairs where a first driver of the pair enters the given road segment later than the other driver and left the given road segment earlier than the other driver (indicative of the first driver having overtaken the other driver). In such cases the embodiments of the present technology result in a determination that the first driver has overtaken the other driver (provided they entered the same sequential road segment after the road segment that is being analyzed).

The determination that the first driver has overtaken the second driver causes the overtaking score associated with the first driver to be increased (the overtaking score being indicative of a frequency of the first driver overtaking). These overtaking scores allow identifying those drivers who overtake more than an "average" driver. This can be achieved, for example, by comparing the overtaking score to a pre-determined threshold. Those drivers that have the overtaking score over the pre-determined threshold can be identified as frequent overtakers and their movement pattern can be discarded when identifying the traffic conditions.

Embodiments of the present technology contemplate, at a time when the server executes an estimation of the traffic condition, the server can discard driving pattern data associated with those electronic devices that are in turn associated with drivers with the overtaking score over a pre-determined threshold (for drivers who frequently overtake) and/or below another pre-determined threshold (for drivers who are being frequently overtaken). In other words, embodiments of the present technology allow identifying and discarding those drivers who are associated with a non-standard driving pattern.

Embodiments of the present technology further contemplate analyzing driving patterns taking into account driver's driving behaviour on sequential road segments. In other words, driver's behavior on road segments adjacent to the current road segment being analyzed can be further considered when determining the event of overtaking on the current road segment and determine whether to adjust the overtaking score.

As an illustration, the significance of the analysis on the subsequent road segments can be illustrated as follows. Consider a situation when most of the cars are standing on a current road segment at a traffic light at a crossroad and are waiting for the green light to drive straight ahead. The are also certain other cars that are using the right-hand lane for turning right (with their "right turn" light being green or turning right on the red light, where allowed by traffic laws) and turn.

In this example, considering that drivers that are turning right and drivers that are driving straight ahead are not using the same consecutive road segment is instrumental in properly determining drivers who frequently overtake. Therefore, analysis of the driver's driving behaviour at a road segment after the current road segment being analyzed is instrumental in allowing embodiments of the present technology to more accurately analyze driving pattern and to identify those drivers that are associated with abnormal driving patterns. Furthermore, ability to discard driving patterns associated with these identified drivers allows for more accurate traffic predictions to be executed by the machine learning algorithm executed by the server executing a traffic prediction application.

In accordance with a first broad aspect of the present technology, there is provided a computer-implemented method for evaluating traffic conditions. The method is executable on a server, the server being in a communication with a plurality of user devices, the plurality of user devices executing a map application, the traffic conditions for displaying by the map application. The method comprising: receiving from at least some of the plurality of user devices device movement data, the device movement data having been generated by the map application, the device movement data indicative of moving patterns of the at least some of the plurality of user devices, each moving pattern including at least an indication of: at least one road segment travelled, at least one time record, each one of the at least one time record associated with a respective road segment travelled, the time record indicating an entry time and an exit time for the respective segment travelled; analyzing the device movement data by: selecting a specific road segment from the at least one road segment travelled; retrieving at least a first movement pattern associated with a first user travelling the specific road segment and a second movement pattern associated with a second user travelling the specific road segment; comparing the first movement pattern and the second movement pattern; responsive to the first movement pattern and the second movement pattern being indicative of the second user entering the specific road segment later than the first user entering the specific road segment and leaving the specific road segment earlier than the first user; and both the first user and the second user subsequently entering a same sequential road segment from the plurality of road segments, the same sequential road segment being adjacent to the specific road segment; incrementing an overtaking score associated with the second user.

In some embodiments of the method, the analyzing the device movement data further comprises: selecting another road segment from the plurality of road segments travelled; retrieving at least a third movement pattern associated with a third user travelling the other road segment and a fourth movement pattern associated with a fourth user travelling the other road segment; comparing the third movement pattern and the fourth movement pattern; responsive to the third movement pattern and the fourth movement pattern being indicative of the fourth user entering the other road segment later than the third user entering the specific road segment and leaving the other road segment earlier than the third user; and the fourth user subsequently entering a first subsequent road segment and the third user entering a second subsequent road segment, the first subsequent road segment and the second subsequent road segment being different, but both adjacent to the other road segment; maintaining the overtaking score associated with the fourth user unchanged.

In some embodiments of the method, the third user and the first user are the same user; the fourth user and the second user are the same user.

In some embodiments of the method, the method further comprises analyzing the overtaking score associated with the second user and the overtaking score associated with the first user; responsive to the overtaking score associated with the first user not exceeding the overtaking threshold and the overtaking score associated with the second user exceeding the overtaking threshold calculating a traffic condition information for the specific road segment based at least in part on the first movement pattern associated with the first user and not on the second movement pattern associated with the second user.

In some embodiments of the method, the method further comprises receiving from a user electronic device a request for the traffic information for the specific road segment; responsive to the request, transmitting to the user electronic device a trigger configured to cause the user electronic device to display the traffic information for the specific road segment.

In some embodiments of the method, the analyzing the device movement data further comprises: selecting another road segment from the plurality of road segments travelled; retrieving at least a third movement pattern associated with a third user travelling the other road segment and a fourth movement pattern associated with a the second user travelling the other road segment; comparing the third movement pattern and the fourth movement pattern; responsive to the third movement pattern and the fourth movement pattern being indicative of the second user entering the other road segment later than the third user entering the specific road segment and leaving the other road segment earlier than the third user; and the third user and the second subsequently entering a same other sequential road segment from the plurality of road segments, the same other sequential road segment being adjacent to the other road segment; further incrementing the overtaking score associated with the second user.

In some embodiments of the method, the analyzing the device movement data further comprises: selecting another road segment from the plurality of road segments travelled; retrieving at least a third movement pattern associated with a third user travelling the other road segment and a fourth movement pattern associated with a the second user travelling the other road segment; comparing the third movement pattern and the fourth movement pattern; responsive to: the third movement pattern and the fourth movement pattern being indicative of the third user entering the other road segment later than the second user entering the specific road segment and leaving the other road segment earlier than the second user; and the third user and the second user subsequently entering a same other sequential road segment from the plurality of road segments, the same other sequential road segment being adjacent to the other road segment; decreasing the overtaking score associated with the second user.

In some embodiments of the method, the method further comprises defining the plurality of road segments travelled based on a pre-defined segmentation rule.

In some embodiments of the method, the the pre-defined segmentation rule is for defining a given road segment having a length of 200 meters.

In some embodiments of the method, the pre-defined segmentation rule is for defining a given road segment being disposed in-between two sequential traffic lights.

In some embodiments of the method, the device movement data further comprises a unique user identifier associated with an originating user of the device movement data.

In some embodiments of the method, the overtaking score associated with the second user is used in determining whether to use device movement data associated with the second user in determining the traffic conditions.

In some embodiments of the method, the the overtaking score associated with the second user is instrumental in determining whether to use device movement data associated with the second user in determining the traffic conditions on a going forward basis.

In some embodiments of the method, if the overtaking score is indicative of the second user having an abnormal driving pattern, the device movement data associated with the second user is not used in determining the traffic conditions for a pre-determined period of future time.

In some embodiments of the method, the abnormal driving pattern is an abnormal overtaking pattern.

In some embodiments of the method, the abnormal overtaking pattern is one of: the second user having a number of overtaking maneuvers over a first threshold; the second user being overtaken for a number of times over a second threshold.

In some embodiments of the method, the method further comprises generating a movement graph, the movement graph made up of nodes interconnected by shoulders, wherein shoulders represent the at least one road segment travelled and the nodes represent an entry point and an exit point into an associated shoulder.

In accordance with another broad aspect of the present technology, there is provided a server for evaluating traffic, the server executing a traffic prediction algorithm. The server is communicatively coupled to an electronic device, the electronic device executing a mapping application for electronically providing to a user of the electronic device the estimated road traffic condition. The server is configured to: receive from at least some of the plurality of user devices device movement data, the device movement data having been generated by the map application, the device movement data indicative of moving patterns of the at least some of the plurality of user devices, each moving pattern including at least an indication of: at least one road segment travelled, at least one time record, each one of the at least one time record associated with a respective road segment travelled, the time record indicating an entry time and an exit time for the respective segment travelled; analyze the device movement data by: selecting a specific road segment from the at least one road segment travelled; retrieving at least a first movement pattern associated with a first user travelling the specific road segment and a second movement pattern associated with a second user travelling the specific road segment; comparing the first movement pattern and the second movement pattern; responsive to the first movement pattern and the second movement pattern being indicative of the second user entering the specific road segment later than the first user entering the specific road segment and leaving the specific road segment earlier than the first user; and both the first user and the second user subsequently entering a same sequential road segment from the plurality of road segments, the same sequential road segment being adjacent to the specific road segment; incrementing an overtaking score associated with the second user.

In the context of the present specification, a "server" is a computer program that is running on appropriate hardware and is capable of receiving requests (e.g. from client devices) over a network, and carrying out those requests, or causing those requests to be carried out. The hardware may be implemented as one physical computer or one physical computer system, but neither is required to be the case with respect to the present technology. In the present context, the use of the expression a "server" is not intended to mean that every task (e.g. received instructions or requests) or any particular task will have been received, carried out, or caused to be carried out, by the same server (i.e. the same software and/or hardware); it is intended to mean that any number of software elements or hardware devices may be involved in receiving/sending, carrying out or causing to be carried out any task or request, or the consequences of any task or request; and all of this software and hardware may be one server or multiple servers, both of which are included within the expression "at least one server".

In the context of the present specification, "electronic device" is any computer hardware that is capable of running software appropriate to the relevant task at hand. In the context of the present specification, the term "electronic device" implies that a device can function as a server for other electronic devices and client devices, however it is not required to be the case with respect to the present technology. Thus, some (non-limiting) examples of electronic devices include personal computers (desktops, laptops, netbooks, etc.), smartphones, and tablets, as well as network equipment such as routers, switches, and gateways. It should be understood that in the present context the fact that the device functions as an electronic device does not mean that it cannot function as a server for other electronic devices. The use of the expression "an electronic device" does not preclude multiple client devices being used in receiving/sending, carrying out or causing to be carried out any task or request, or the consequences of any task or request, or steps of any method described herein.

In the context of the present specification, "client device" is any computer hardware that is capable of running software appropriate to the relevant task at hand. In the context of the present specification, in general the term "client device" is associated with a user of the client device. Thus, some (non-limiting) examples of client devices include personal computers (desktops, laptops, netbooks, etc.), smartphones, and tablets, as well as network equipment such as routers, switches, and gateways It should be noted that a device acting as a client device in the present context is not precluded from acting as a server to other client devices. The use of the expression "a client device" does not preclude multiple client devices being used in receiving/sending, carrying out or causing to be carried out any task or request, or the consequences of any task or request, or steps of any method described herein.

In the context of the present specification, the expression "information" includes information of any nature or kind whatsoever capable of being stored in a database. Thus information includes, but is not limited to audiovisual works (images, movies, sound records, presentations etc.), data (location data, numerical data, etc.), text (opinions, comments, questions, messages, etc.), documents, spreadsheets, etc.

In the context of the present specification, the expression "software component" is meant to include software (appropriate to a particular hardware context) that is both necessary and sufficient to achieve the specific function(s) being referenced.

In the context of the present specification, the expression "computer information storage media" (also referred to as "storage media") is intended to include media of any nature and kind whatsoever, including without limitation RAM, ROM, disks (CD-ROMs, DVDs, floppy disks, hard drivers, etc.), USB keys, solid state-drives, tape drives, etc. A plurality of components may be combined to form the computer information storage media, including two or more media components of a same type and/or two or more media components of different types.

In the context of the present specification, a "database" is any structured collection of data, irrespective of its particular structure, the database management software, or the computer hardware on which the data is stored, implemented or otherwise rendered available for use. A database may reside on the same hardware as the process that stores or makes use of the information stored in the database or it may reside on separate hardware, such as a dedicated server or plurality of servers.

In the context of the present specification, the words "first", "second", "third", etc. have been used as adjectives only for the purpose of allowing for distinction between the nouns that they modify from one another, and not for the purpose of describing any particular relationship between those nouns. Thus, for example, it should be understood that, the use of the terms "first database" and "third server" is not intended to imply any particular order, type, chronology, hierarchy or ranking (for example) of/between the server, nor is their use (by itself) intended imply that any "second server" must necessarily exist in any given situation. Further, as is discussed herein in other contexts, reference to a "first" element and a "second" element does not preclude the two elements from being the same actual real-world element. Thus, for example, in some instances, a "first" server and a "second" server may be the same software and/or hardware components, in other cases they may be different software and/or hardware components.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

These and other features, aspects and advantages of the present technology will become better understood with regard to the following description, appended claims and accompanying drawings where:

DETAILED DESCRIPTION

Figure 1:
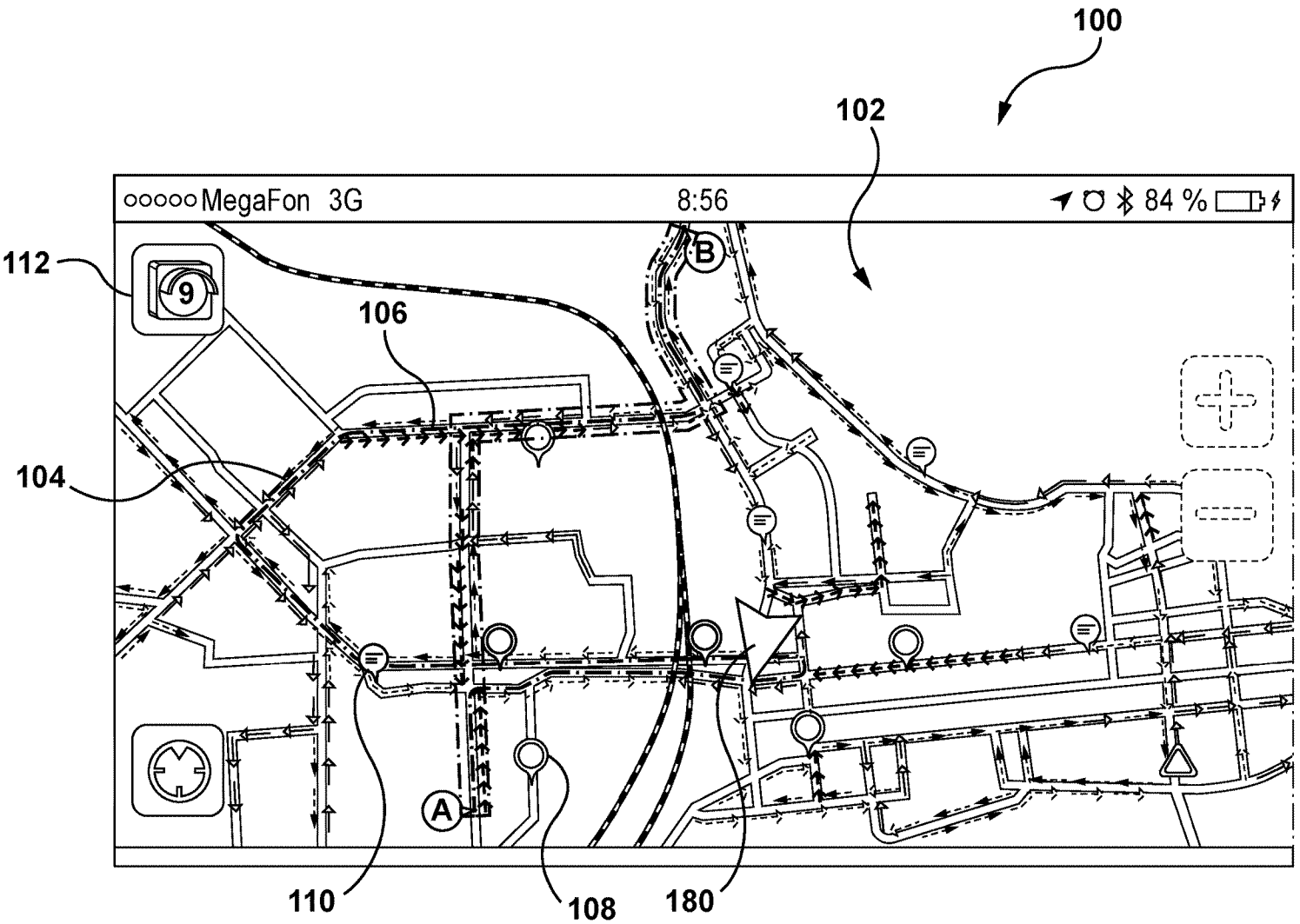
FIG. 1 (PRIOR ART)
FIG. 1 depicts a screenshot of a mapping application, the screenshot that can be shown on an example of the wireless device, the screen shot being implemented by prior art mapping applications.

The examples and conditional language recited herein are principally intended to aid the reader in understanding the principles of the present technology and not to limit its scope to such specifically recited examples and conditions. It will be appreciated that those skilled in the art may devise various arrangements which, although not explicitly described or shown herein, nonetheless embody the principles of the present technology and are included within its spirit and scope.

Furthermore, as an aid to understanding, the following description may describe relatively simplified implementations of the present technology. As persons skilled in the art would understand, various implementations of the present technology may be of a greater complexity.

In some cases, what are believed to be helpful examples of modifications to the present technology may also be set forth. This is done merely as an aid to understanding, and, again, not to define the scope or set forth the bounds of the present technology. These modifications are not an exhaustive list, and a person skilled in the art may make other modifications while nonetheless remaining within the scope of the present technology. Further, where no examples of modifications have been set forth, it should not be interpreted that no modifications are possible and/or that what is described is the sole manner of implementing that element of the present technology.

Moreover, all statements herein reciting principles, aspects, and implementations of the technology, as well as specific examples thereof, are intended to encompass both structural and functional equivalents thereof, whether they are currently known or developed in the future. Thus, for example, it will be appreciated by those skilled in the art that any block diagrams herein represent conceptual views of illustrative circuitry embodying the principles of the present technology. Similarly, it will be appreciated that any flowcharts, flow diagrams, state transition diagrams, pseudocode, and the like represent various processes which may be substantially represented in computer-readable media and so executed by a computer or processor, whether or not such computer or processor is explicitly shown.

The functions of the various elements shown in the figures, including any functional block labeled as a "processor", may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read-only memory (ROM) for storing software, random access memory (RAM), and non-volatile storage. Other hardware, conventional and/or custom, may also be included.

Software modules, or simply modules which are implied to be software, may be represented herein as any combination of flowchart elements or other elements indicating performance of process steps and/or textual description. Such modules may be executed by hardware that is expressly or implicitly shown.

With these fundamentals in place, we will now consider some non-limiting examples to illustrate various implementations of aspects of the present technology.

Figure 3:
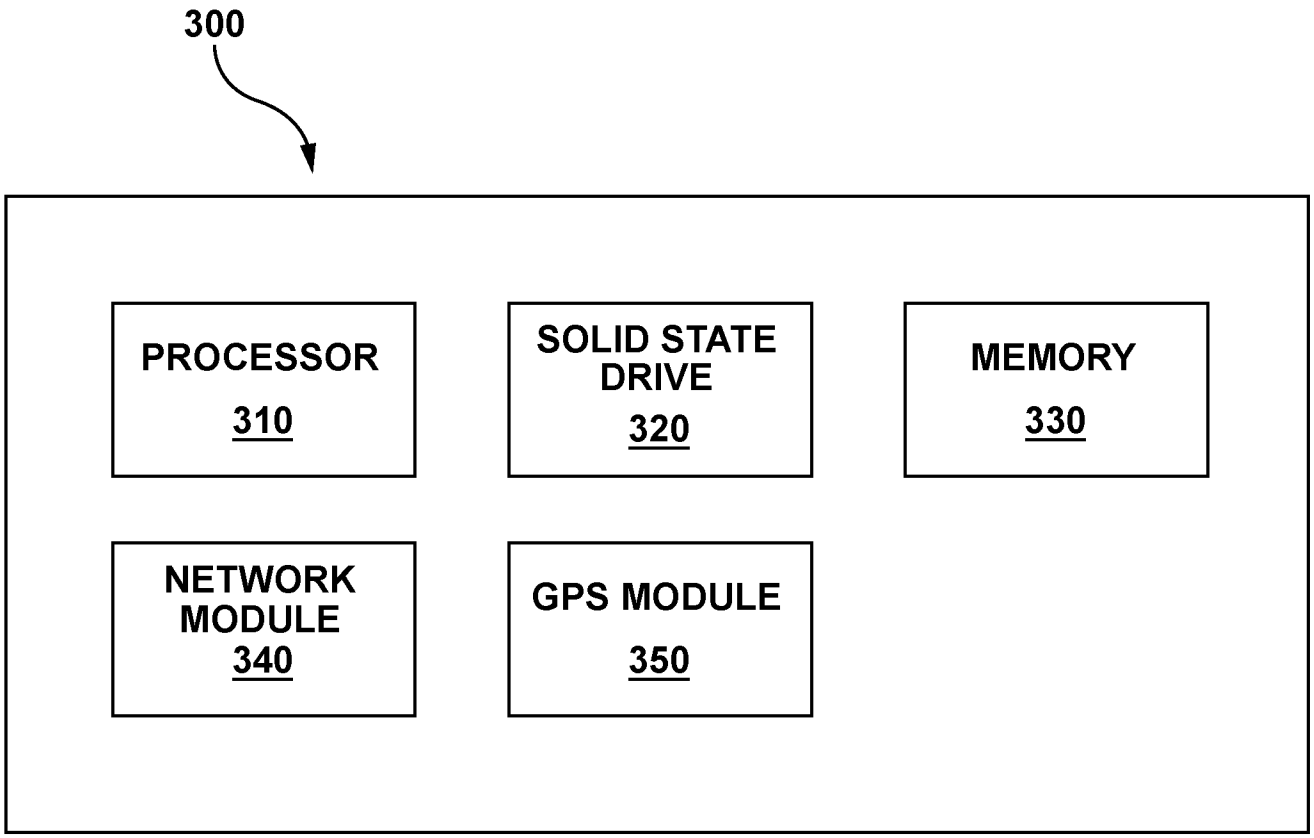
FIG. 3 depicts a schematic diagram of an example computer system for implementing certain embodiments of systems and/or methods of the present technology.

With reference to FIG. 3, there is shown an electronic device 300 suitable for use with some implementations of the present technology, the electronic device 300 comprising various hardware components including one or more single or multi-core processors collectively represented by a processor 310, a solid-state drive 320, a memory 330, which may be a random-access memory, a network module 340, and a GPS module 350. Communication between the various components of the electronic device 300 may be enabled by one or more internal and/or external buses (not shown) (e.g. a PCI bus, universal serial bus, IEEE 1394 "Firewire" bus, SCSI bus, Serial-ATA bus, etc.), to which the various hardware components are electronically coupled. According to embodiments of the present technology, the solid-state drive 320 stores program instructions suitable for being loaded into the memory 330 and executed by the processor 310 for displaying information to a user of the electronic device 300 as will be described in further detail below. For example, the program instructions may be part of a mapping or navigational application executable by the processor 310. The network module 340 and the GPS module 350 allow communication between different computer systems, servers and/or other devices.

Figure 4:
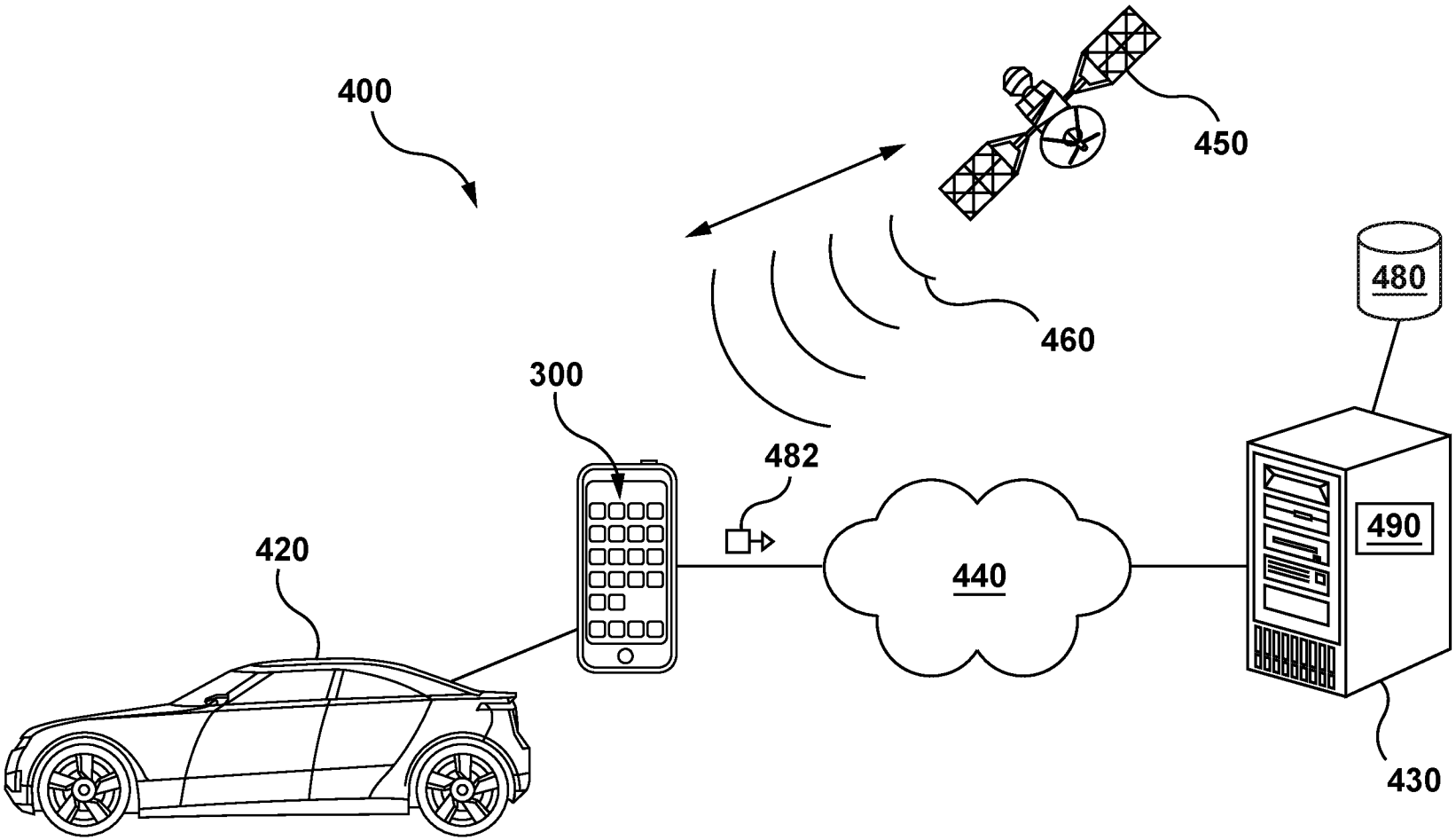
FIG. 4 depicts a schematic diagram of an example networked computing environment in which certain embodiments of systems and/or methods of the present technology may be implemented.

FIG. 4 illustrates a networked computing environment 400 suitable for use with some embodiments of the systems and/or methods of the present technology. The networked computing environment 400 comprises the electronic device 300 associated with a vehicle 420, or associated with a user (not depicted) who can operate the vehicle 420. The networked computing environment 400 further comprises a server 430 in communication with the electronic device 300 via a communications network 440 (e.g. the Internet or the like, as will be described in greater detail herein below), and a GPS satellite 450 transmitting and/or receiving a GPS signal 460 to/from the electronic device 300. It will be understood that the present technology is not limited to GPS and may employ a positioning technology other than GPS.

The implementation of the electronic device 300 is not particularly limited, but as an example, the electronic device 300 may be implemented as a wireless communication device such as a mobile telephone (e.g. a smart phone or a radio-phone), a portable navigation device (e.g. TomTom™, Garmin™), a navigational device built-in into the vehicle 420, a tablet, a personal computer and the like. However in FIG. 3, the electronic device 300 is depicted as the smart phone.

The network module 340 of the electronic device 300 is configured for communication with the server 430 via the communications network 440, the GPS module 150 of the electronic device 300 is configured for receiving and transmitting the GPS signal 460 from and to the GPS satellite 450 (i.e., for enabling GPS capabilities of the electronic device 300). The electronic device 300 further comprises hardware and/or software and/or firmware, or a combination thereof, for receiving navigational information, as will be described in greater detail below.

The vehicle 420 with which the electronic device 300 is associated may comprise any leisure or commercial vehicle (such as a private or commercial car, truck, motorbike or the like). The vehicle 420 may be user operated or a driver-less vehicle. As previously mentioned, the user associated with the vehicle 420 may also be associated with the electronic device 300. Alternatively, the vehicle 420 itself may be associated with the electronic device 300 in those embodiments, where the electronic device 300 is a built-in device. It should be noted that the fact that the electronic device 300 is associated with the user does not need to suggest or imply any mode of operation—such as a need to log in, a need to be registered or the like. Similarly, the fact that the electronic device 300 is associated with the vehicle 420 does not need to suggest or imply any mode of operation. In other words, the associations between the user, the vehicle 420 and the electronic device 300 denote the assumption that the user has access to the electronic device 300 while it is travelling in the vehicle 420.

In some embodiments of the present technology, the communications network 440 is the Internet. In alternative non-limiting embodiments, the communication network can be implemented as any suitable local area network (LAN), wide area network (WAN), a private communication network or the like. It should be expressly understood that implementations for the communication network are for illustration purposes only. How a communication link (not separately numbered) between the electronic device 300 and the communications network 440 is implemented will depend inter alia on how the electronic device 300 is implemented.

Merely as an example and not as a limitation, in those embodiments of the present technology where the electronic device 300 is implemented as a wireless communication device such as a smart phone or a navigation device, the communication link can be implemented as a wireless communication link. Examples of wireless communication links include, but are not limited to, a 3G communication network link, a 4G communication network link, and the like. The communications network 440 may also use a wireless connection with the server 430.

In some embodiments of the present technology, the server 430 is implemented as a conventional computer server. In one non-limiting example, the server 430 is implemented as a Dell™ PowerEdge™ Server running the Microsoft™ Windows Server™ operating system, but can also be implemented in any other suitable hardware, software, and/or firmware, or a combination thereof. In the depicted non-limiting embodiments of the present technology, the server is a single server. In alternative non-limiting embodiments of the present technology (not shown), the functionality of the server 430 may be distributed and may be implemented via multiple servers.

In some embodiment of the present technology, the server 430 comprises hardware and/or software and/or firmware, or a combination thereof, for computing and transmitting at least geographic map data and navigational information to the electronic device 300. The server 430 comprises hardware and/or software and/or firmware, or a combination thereof, for executing a machine learning algorithm for executing a traffic prediction routine.

To that end, the server 430 may host one or more navigational services that provide at least geographic map data and navigational information to various electronic devices, including the electronic device 300. Indeed, the one or more navigational services of the server 430 may allow the retrieval of relevant geographic map data. The one or more navigational services of the server 430 may also implement a traffic prediction algorithm (not depicted), such as a machine-learning model generated by the aforementioned machine learning algorithm for example, for determining the navigational information.

In some embodiments, merely as an illustration and not a limitation, the navigational service of the server 430 that provides at least the geographical map data and implements the traffic prediction algorithm is Yandex.Maps™.

In some embodiments of the present technology, the traffic prediction algorithm may have been previously trained based on previous user travel information. For example, the server 430 may have been configured to collect large amounts of data associated with a plurality of users travelling around in a given geographical region. This collection of large amounts of data may be known as user geo-tracking. Generally speaking, the server 430 may be configured to (i) analyze these large amounts of data, (ii) determine movement patterns that the plurality of users performed in that given geographical region, and (iii) determine temporal information associated with the movement patterns and which is indicative of travel time intervals and periods of the day during which these movement patterns were performed.

Figure 2:
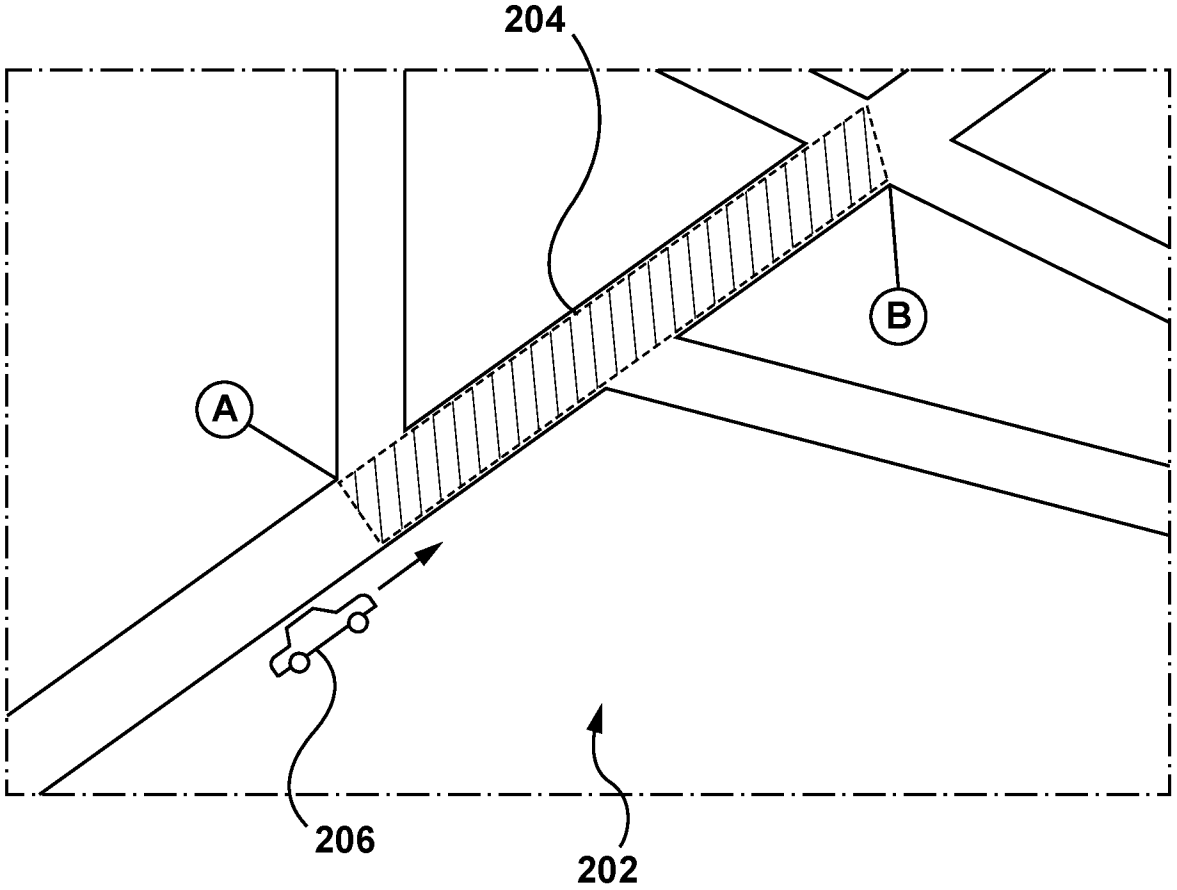
FIG. 2 (PRIOR ART)
FIG. 2 depicts a portion of an actual road segment (such as one that can be used to generate the map that id displayed within the screen shot of FIG. 1).

Embodiments of the present technology contemplate augmenting the process described with reference to FIG. 2 as follows. In accordance with embodiments of the present technology, the server 430 is configured to execute an overtaking score calculation routine 490 that populates and maintains an overtaking score database 480.

In accordance with embodiments of the present technology, the overtaking score calculation routine 490 is configured to collect information about all electronic devices that use the navigational service executed by the server 430, including the electronic device 300. More specifically but without being limitative, the overtaking score calculation routine 490 can collect information about all (or some) electronic device entering a particular road segment (with the associated time stamp) and exiting the particular road segment (with the associated time stamp).

The overtaking score calculation routine 490 is also configured to define one or more particular road segments. In some embodiments of the present technology, the overtaking score calculation routine 490 segments all the roads that are available within the map information processed by the server 430 into the road segments based on a pre-defined segmentation rule. In some non-limiting embodiment of the present technology, the pre-defined segmentation rule is for defining a given road segment having a length of 200 meters (or any other suitable length, the 300 meters being merely an example).

In other words, a given road (such as a city street, a highway, etc) is broken down into a plurality of road segments having a length of 200 meters. Naturally, any other length for the particular road segment can be used. In other non-limiting embodiments of the present technology, the pre-defined segmentation rule is for defining a given road segment being disposed in-between two sequential traffic lights. It should be noted that different segmentation rules can be applied to different types of roads. For example, in some other non-limiting embodiments of the present technology, a first type of pre-defined segmentation rule can be used for city streets, a second type of pre-determined segmentation rule can be used for country roads and third type of pre-determined segmentation rule can be used for highways.

In other words, the overtaking score calculation routine 490 executed by the server 430 is configured to receive from the electronic device 300 an indication of device movement data 482 (depicted in FIG. 4). The device movement data 482 can be generated by a map application executed by the electronic device 300 and transmitted to the server 430. The electronic device 300 can transmit the indication of the device movement data 482 on regular basis, as an example (such as at an end of every day or every 4 hours) or upon completion of a particular event (such as completion of a route, as an example).

Figure 5:
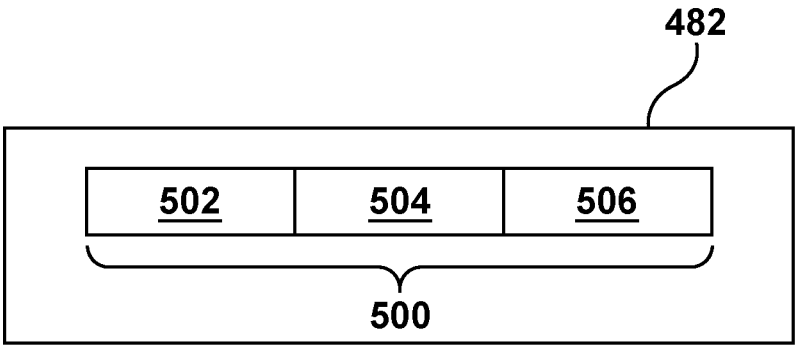
FIG. 5 depicts a schematic illustration of the content of a device movement data exchanged within the networked computing environment of FIG. 4.

With brief reference to FIG. 5, there is depicted a schematic illustration of the content of the device movement data 482. The content of the device movement data 482 includes an indication of movement patterns 500 of the electronic device 300. The movement pattern 500 of the electronic device 300 includes at least an indication of: (i) at least one road segment travelled 502 (in a form of a road segment identifier and the like), (ii) at least one time record, each one of the at least one time record associated with a respective road segment travelled, the time record indicating an entry time 504 and an exit time 506 for the respective segment travelled. Even though not depicted in FIG. 5, the device movement data 482 is also associated with a unique identifier, which unique identifier can be associated with the electronic device 300 or the user of the electronic device 300. The nature of the unique identifier is not limited, but it is purpose is to be able to identify (directly or indirectly) a driver (also referred herein below as a "user") associated with the vehicle 420.

It is noted that the device movement data 482 can include additional information in the movement patterns 500. By the same token, it is possible that the device movement data 482 can include indications of multiple movement patterns 500 (associated with different road segments travelled). Alternatively, each of the device movement data 482 can be associated with a respective movement pattern 500 associated with its respective road segment travelled.

The overtaking score calculation routine 490 is further configured to analyze the device movement data 482. What follows is description of one example routine for the overtaking score calculation routine 490 to analyze the device movement data 482.

The overtaking score calculation routine 490 is configured to analyze the device movement data 482 received from a plurality of electronic devices, including the electronic device 300. As such, the overtaking score calculation routine 490 analyzes device movement data 482 from multiple drivers driving (or more specifically, drivers that have driven) multiple road segments.

In the process of analyzing device movement data 482, the overtaking score calculation routine 490 selects a specific road segment 502 from the at least one road segment travelled 502 (received as part of the device movement data 482). The overtaking score calculation routine 490 then retrieves all information about the movement (i.e. the multiple movement patterns 500) through the specific road segment 502 for a pre-determined period of time (such as 15 minutes, 30 minutes, 45 minutes, 2 hours, 24 hours, and the like) prior to the time when the analysis is executed. The overtaking score calculation routine 490 retrieves, from the multiple movement patterns 500, the time record (the entry time 504 and the exit time 506) for each driver who has travelled the specific road segment 502 during the time interval that is being analyzed.

The overtaking score calculation routine 490 then analyzes the time records contained in the multiple movement patterns 500 of every pair of the drivers being analyzed. More specifically, let is be assumed that a given pair of drivers being analyzed is associated with the following data:

| |
|---|
| Driver_1 (T1, T2) |
| Driver_2 (T3, T4) |

Within this example, T1 is the entry time 504 and T2 is the exit time 506 associated with the first driver being analyzed and T3 is the entry time 504 and T4 is the exit time 506 associated with the second driver being analyzed, the first driver and the second driver being part of a specific pair of drivers being analyzed. For the purposes of the illustration, let it be assumed that T1<T3, in other words that the first driver has entered the specific road segment 502 before the second driver (or, conversely, that the second driver entered the specific road segment 502 after the first driver).

There are three potential outcomes of the analysis of the multiple movement patterns 500 by the overtaking score calculation routine 490.

It may happen that the overtaking score calculation routine 490 determines that T2<=T3 (indicative that the second driver has entered the specific road segment 502 after the first driver has left the specific road segment 502. The overtaking score calculation routine 490 then determines that the first driver and the second driver have not crossed paths within the specific road segment 502. The overtaking score calculation routine 490 ignores this specific pair of drivers.

It may also happen that the overtaking score calculation routine 490 determines that T3<T2<T4 (indicative that the second driver has exited the specific road segment 502 after the first driver). Recalling that the second driver has entered the specific road segment 502 after the first driver, the overtaking score calculation routine 490 determines that the first driver has not overtaken the second drover (or vice versa).

In some embodiments of the present technology, the overtaking score calculation routine 490, within the above second scenario, additionally analyzes an overlap between [T1, T2] and [T3, T4]. In some embodiments of the present technology, the overtaking score calculation routine 490, in response to the overlap being lower than 50% (or another selected threshold) discard this particular pair of drivers.

It may also happen that the overtaking score calculation routine 490 determines that T4<T2 (indicative that the second driver has exited the specific road segment 502 before the first driver). Recalling that the second driver has entered the specific road segment 502 after the first driver, the overtaking score calculation routine 490 determines that the first driver has overtaken the second drover in the specific road segment 502.

In some embodiments, the overtaking score calculation routine 490 further analyzes multiple movement patterns 500 associated with another specific road segment 502 after the specific road segment 502, the another specific road segment 502 being sequential to the specific road segment 502.

More specifically, the overtaking score calculation routine 490 determines if the movement pattern 500 with the first driver and the movement pattern 500 associated with the second driver are indicative of the first driver and the second driver taking the same sequential road segment 502 or different sequential road segments 502. The latter can occur, for example, when the second driver has driven straight ahead at an intersection (a first sequential road segment 502) and the first driver has turned right (a second sequential road segment 502).

In some embodiments of the present technology, the overtaking score calculation routine 490 discards the analysis of the first driver and the second driver if they have driven to different sequential road segments 205. On the other hand, if the overtaking score calculation routine 490 determines that both the first user and the second drivers subsequently entered the same sequential road segment 502, the overtaking score calculation routine 490 increments an overtaking score associated with the second driver (if the analysis so warrants, as described above).

Figure 6:
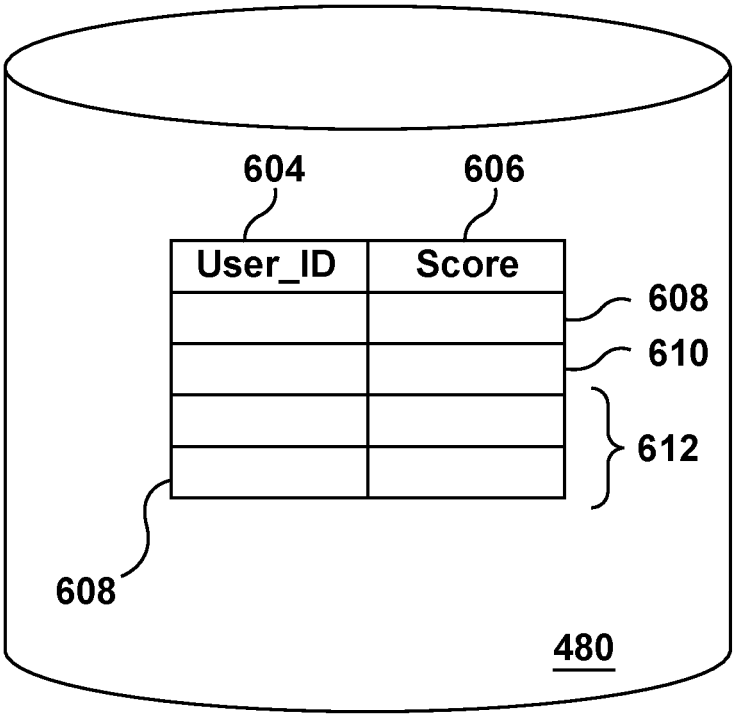
FIG. 6 depicts a non-limiting embodiment of an overtaking score database maintained within the networked computing environment of FIG. 4.

To that end, the overtaking score calculation routine 490 is configured to maintain the aforementioned overtaking score database 480. With reference to FIG. 6, there is depicted a non-limiting embodiment of the overtaking score database 480. The overtaking score database 480 stores overtaking score information 602 associated with a plurality of drivers (using the respective electronic device 300 as a proxy for the plurality of drivers).

The overtaking score information 602 can be organized as a table and contain an indication of a user 604 and an indication of an overtaking score 606 for the associated user.

The overtaking score information 602 contains a number of entries, such as a first entry 608, a second entry 610 and a plurality of additional entries 612; each of the first entry 608, the second entry 610 and the plurality of additional entries 612 being respectively associated with a specific driver. To that end, for each record of the first entry 608, the second entry 610 and the plurality of additional entries 612, its indication of the user 604 stores a unique identifier of the associated driver. As has been mentioned above, the electronic device 300 can be used as a "proxy" for the driver. As such, the indication of the user 604 can store one or more of: a unique user identifier (such as User_ID, etc), a unique identifier of the electronic device 300 associated with the driver (such as Device_ID, an IP address, a MAC address, and the like).

The overtaking score 606 of the given one of the first entry 608, the second entry 610 and the plurality of additional entries 612 stores an indication of the overtaking score, which is generated (and updated) as has been briefly described above and as will be described in greater detail herein below.

In some embodiments of the present technology, the overtaking score calculation routine 490 is configured to determine which drivers are "atypical" in the sense that they do not tend to drive with the general flow of the traffic. Such atypical drivers can be drivers who tend to frequently overtake and/or drivers who tend to be frequently overtaken by others.

In some embodiments of the present technology, the overtaking score calculation routine 490 analyzes the data stored within the overtaking score 606 of the various drivers. In some embodiments of the present technology, the overtaking score calculation routine 490 can perform a win-loss algorithm analysis (the "win" being the drivers who overtake and the "loss" being drivers who are overtaken).

In some embodiments of the present technology, the overtaking score calculation routine 490 determines those drivers that tend to overtake more than a pre-determined threshold (the frequent overtaker threshold, as an example, can be WIN >0.25) or those drivers that tend to be overtaken more than a pre-determined threshold (LOSS >0.35). The exact value of the WIN and the LOSS can be determined empirically and take into account a number of parameters. In the example specified above, the threshold for frequent overtakers is lower than the threshold for drivers who are frequently overtaken based on an empirical observation that there are statistically more drivers that tend to overtake than those that tend to be overtaken.

In some embodiments of the present technology, the overtaking score calculation routine 490 discards movement patterns 500 of the drivers who have been determined to be either frequent overtakers or those that are frequently overtaken. In other words, the overtaking score calculation routine 490 ignores movement patterns 500 of those drivers that are deemed to be abnormal by the algorithm implemented by the overtaking score calculation routine 490.

The overtaking score calculation routine 490 can ignore movement patterns 500 of those drivers on a "looking forward" basis. In some embodiments, the overtaking score calculation routine 490 ignores moving patterns of these drivers for the same day. In other embodiments, the overtaking score calculation routine 490 ignores moving patterns of these drivers for a pre-determined period of time into the future.

Figure 7:
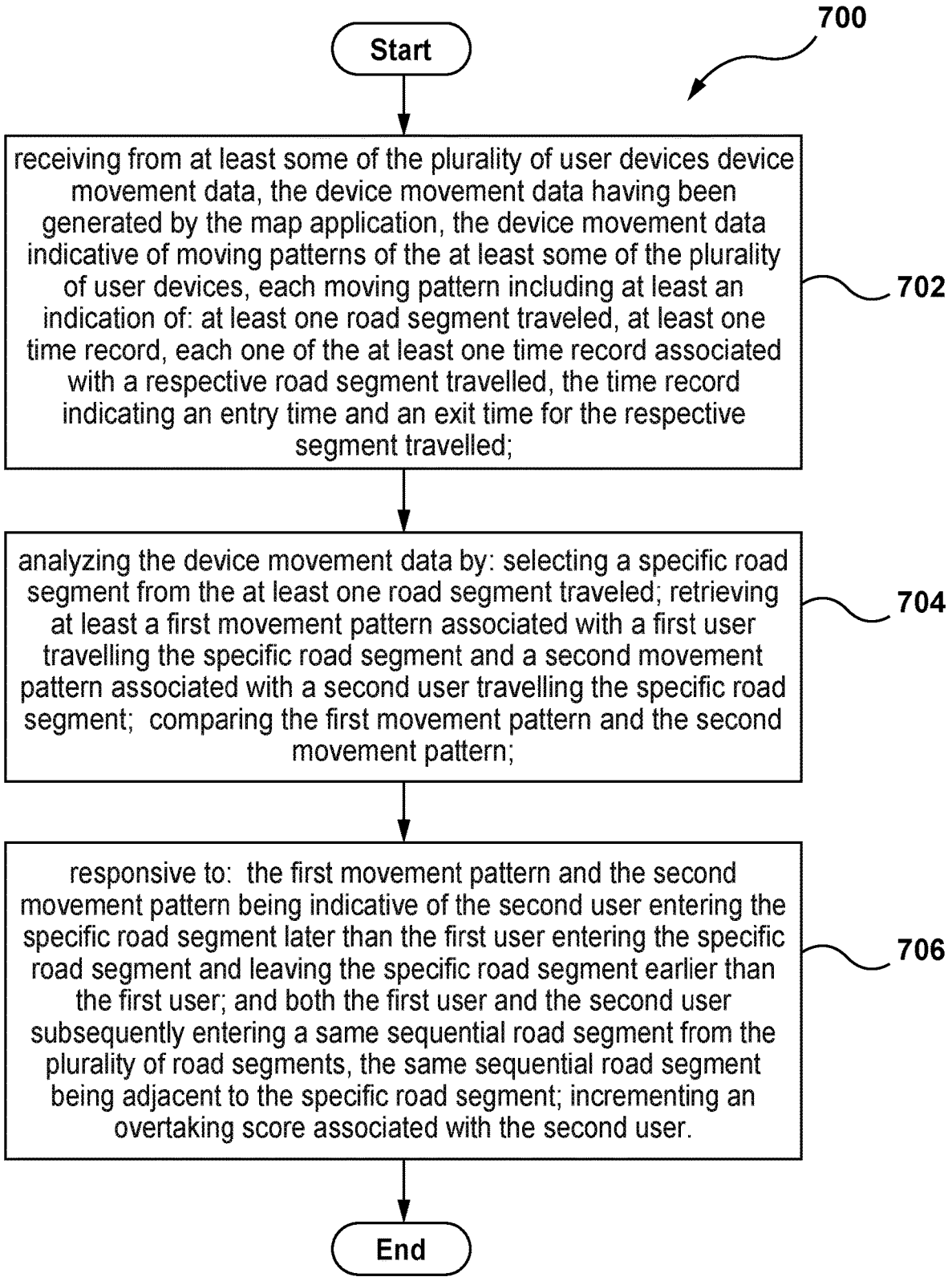
FIG. 7 depicts a block diagram of a flow chart of a method being executed within the networked computing environment of FIG. 4, the method being implemented in accordance with non-limiting embodiments of the present technology.

Given the architecture described above it is possible to execute a method for evaluating traffic conditions and for generating a traffic forecast. With reference to FIG. 7, there is depicted a block diagram of a flow chart of a method 700, the method 700 being executed in accordance with non-limiting embodiments of the present technology. The method 700 is a computer-implemented method for evaluating traffic conditions, the method 700 being executable on the server 430.

Step 702—receiving from at least some of the plurality of user devices device movement data, the device movement data having been generated by the map application, the device movement data indicative of moving patterns of the at least some of the plurality of user devices, each moving pattern including at least an indication of: at least one road segment travelled, at least one time record, each one of the at least one time record associated with a respective road segment travelled, the time record indicating an entry time and an exit time for the respective segment travelled.

The method 700 starts at step 702, where the server 430 receives from at least some of the plurality of user devices (i.e. the electronic device 300) device movement data 482, the device movement data 482 having been generated by the map application that is executable by the electronic device 300.

As has been alluded to above, the device movement data 482 is indicative of movement patterns 500 of the at least some of the plurality of user devices (i.e. the electronic device 300). Each movement pattern 500 includes at least an indication of: at least one road segment travelled, at least one time record, each one of the at least one time record associated with a respective road segment travelled, the time record indicating an entry time and an exit time for the respective segment travelled. It should be recalled that the movement pattern 500 is generated by the electronic device 300 and the user associated therewith is moving along a route and is using (or has running in the background) the mapping application.

The server 430 can obtain indication of the movement pattern 500 as part of the above described device movement data 482. The server 430 stores the movement patterns 500 in its internal memory for future analysis.

It is noted that in some embodiments of the present technology, the device movement data 482 further comprises a unique user identifier associated with an originating user of the device movement data.

Step 704—analyzing the device movement data by: selecting a specific road segment from the at least one road segment travelled; retrieving at least a first movement pattern associated with a first user travelling the specific road segment and a second movement pattern associated with a second user travelling the specific road segment; comparing the first movement pattern and the second movement pattern.

At step 704, the server 430 analyzes the device movement data 482. The server 430 analyzes the device movement data 482 associated with multiple electronic devices 300.

The server 430 analyzes the device movement data 482 by: selecting a specific road segment from the at least one road segment travelled; retrieving at least a first movement pattern 500 associated with a first user travelling the specific road segment and a second movement pattern 500 associated with a second user travelling the specific road segment. The server 430 then compares the first movement pattern 500 and the second movement pattern 500.

It should be recalled that the server 430 analyzes the pair of drivers to determine the relative timing of them entering the specific road segment and exiting the specific road segment. The server 430 further analyzes if the two drivers of the pair of drivers have proceeded to the same sequential road segment or different sequential road segments.

Step 706—responsive to the first movement pattern and the second movement pattern being indicative of the second user entering the specific road segment later than the first user entering the specific road segment and leaving the specific road segment earlier than the first user; and both the first user and the second user subsequently entering a same sequential road segment from the plurality of road segments, the same sequential road segment being adjacent to the specific road segment; incrementing an overtaking score associated with the second user.

At step 706, responsive to the first movement pattern 500 and the second movement pattern 500 being indicative of the second user entering the specific road segment later than the first user entering the specific road segment and leaving the specific road segment earlier than the first user; and both the first user and the second user subsequently entering a same sequential road segment from the plurality of road segments, the same sequential road segment being adjacent to the specific road segment; the server 430 increments an overtaking score associated with the second user that is stored in the overtaking score database 480 in the record associated with the second user.

In some additional embodiments of the present technology, the server 430, as part of the analyzing the device movement data, further executes: selecting another road segment from the plurality of road segments travelled; retrieving at least a third movement pattern 500 associated with a third user travelling the other road segment and a fourth movement pattern 500 associated with a the second user travelling the other road segment. The electronic device 300 the compares the third movement pattern 500 and the fourth movement pattern 500. Responsive to the third movement pattern 500 and the fourth movement pattern 500 being indicative of the second user entering the other road segment later than the third user entering the specific road segment and leaving the other road segment earlier than the third user; and the third user and the second subsequently entering a same other sequential road segment from the plurality of road segments, the same other sequential road segment being adjacent to the other road segment; the server 430 further increments the overtaking score associated with the second user.

In alternative embodiments of the present technology, it is contemplated that in response to the server 430 determining that the second user has been overtaking by the third user, the server 430 can decrease the overtaking score associated with the second user. As such, in yet additional embodiments of the present technology, the server 430, as part of the analyzing the device movement data further, selects another road segment from the plurality of road segments travelled.

The server 430 then retrieves at least a third movement pattern 500 associated with a third user travelling the other road segment and a fourth movement pattern 500 associated with a the second user travelling the other road segment and compares the third movement pattern 500 and the fourth movement pattern 500. Responsive to the third movement pattern 500 and the fourth movement pattern 500 being indicative of the third user entering the other road segment later than the second user entering the specific road segment and leaving the other road segment earlier than the second user; and the third user and the second user subsequently entering a same other sequential road segment from the plurality of road segments, the same other sequential road segment being adjacent to the other road segment; the server 430 decreases the overtaking score associated with the second user.

In other words, the server 430 can compare the movement pattern 500 associated with the second user with movement patterns 500 of multiple other users and increase/decrease the overtaking score associated with the second driver based on the outcome of the comparison of the movement patterns 500, as described above.

In additional non-limiting embodiment of the present technology, the server 430 can select another road segment from the plurality of road segments travelled. For the other road segment, the server 430 retrieves at least a third movement pattern 500 associated with a third user travelling the other road segment and a fourth movement pattern 500 associated with a fourth user travelling the other road segment. The server 430 then compares the third movement pattern 500 and the fourth movement pattern 500. Responsive to the third movement pattern 500 and the fourth movement pattern 500 being indicative of the fourth user entering the other road segment later than the third user entering the specific road segment and leaving the other road segment earlier than the third user; and the fourth user subsequently entering a first subsequent road segment and the third user entering a second subsequent road segment, the first subsequent road segment and the second subsequent road segment being different, but both adjacent to the other road segment; the server 430 maintains the overtaking score associated with the fourth user unchanged.

In some embodiments of the present technology, the server 430 further analyzes the overtaking score associated with the second user and the overtaking score associated with the first user. Responsive to the overtaking score associated with the first user not exceeding the overtaking threshold and the overtaking score associated with the second user exceeding the overtaking threshold, the server 430 calculates a traffic condition information for the specific road segment based at least in part on the first movement pattern 500 associated with the first user and not on the second movement pattern 500 associated with the second user. In other words, in response to the server 430 determining that the second user is associated with an abnormal driving pattern (i.e. the second user appears to be an often overtaker), the server 430 discards the movement pattern 500 associated with the second driver.

In accordance with embodiments of the present technology, the overtaking score associated with the second user is used in determining whether to use device movement data 482 associated with the second user in determining the traffic conditions. It can also be said that the overtaking score associated with the second user is instrumental in determining whether to use device movement data 482 associated with the second user in determining the traffic conditions on a going forward basis.

As such, in some alternative embodiments of the present technology, the server 430 receives from a user electronic device (such as the electronic device 300) a request for the traffic information for the specific road segment. Responsive to the request, transmitting to the user electronic device a trigger configured to cause the user electronic device (such as the electronic device 300) to display the traffic information for the specific road segment. In accordance with embodiments of the present technology, the traffic information has been generated based on the movement pattern 500 of the drivers that exclude drivers that have been determined to be atypical.

In yet additional embodiments of the present technology, the method 700 further comprises defining the plurality of road segments travelled based on a pre-defined segmentation rule. Broadly speaking, the pre-defined segmentation rule is for defining a given road segment having a length of 200 meters. The pre-defined segmentation rule can be for defining a given road segment being disposed in-between two sequential traffic lights.

It is noted that in accordance with embodiments of the present technology, the overtaking score is associated with a specific driver and not a specific road segment. Broadly speaking, the overtaking score is indicative of the second user having an abnormal driving pattern, the device movement data associated with the second user is not used in determining the traffic conditions for a pre-determined period of future time. In accordance with embodiments of the present technology, the abnormal driving pattern is an abnormal overtaking pattern. The abnormal overtaking pattern is one of: the second user having a number of overtaking maneuvers over a first threshold; the second user being overtaken for a number of times over a second threshold.

In some embodiments of the present technology, the method 700 further comprises generating a movement graph, the movement graph made up of nodes interconnected by shoulders, wherein shoulders represent the at least one road segment travelled and the nodes represent an entry point and an exit point into an associated shoulder.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A computer-implemented method for evaluating traffic conditions, the method executable on a server, the server being in a communication with a plurality of user devices, the plurality of user devices executing a map application, the traffic conditions for displaying by the map application, the method comprising:

receiving from at least two of the plurality of user devices device movement data, the device movement data having been generated by the map application, the device movement data indicative of moving patterns of the at least two of the plurality of user devices, each moving pattern including at least an indication of:

at least one road segment traveled, at least one time record, each one of the at least one time record associated with a respective road segment traveled, the time record indicating an entry time and an exit time for the respective segment traveled;

analyzing the device movement data by:

selecting a road segment from the at least one road segment traveled;

retrieving at least a first movement pattern associated with a first user device travelling the selected road segment and a second movement pattern associated with a second user device travelling the selected road segment;

comparing the first movement pattern and the second movement pattern;

responsive to both of:

(i) the first movement pattern and the second movement pattern being indicative of the second user device entering the selected road segment later than the first user device entering the selected road segment and leaving the selected road segment earlier than the first user device;

and (ii) both the first user device and the second user device subsequently entering a same sequential road segment from the plurality of road segments, the same sequential road segment being adjacent to the selected road segment;

executing:

incrementing an overtaking score associated with the second user device.

2. The method of claim 1, wherein said analyzing the device movement data further comprises:

selecting another road segment from the plurality of road segments travelled;

retrieving at least a third movement pattern associated with a third user device travelling the other road segment and a fourth movement pattern associated with a fourth user device travelling the other road segment;

comparing the third movement pattern and the fourth movement pattern;

responsive to both of:

(i) the third movement pattern and the fourth movement pattern being indicative of the fourth user device entering the other road segment later than the third user device entering the selected road segment and leaving the other road segment earlier than the third user device;

and (ii) the fourth user device subsequently entering a first subsequent road segment and the third user device entering a second subsequent road segment, the first subsequent road segment and the second subsequent road segment being different, but both adjacent to the other road segment;

executing:

maintaining the overtaking score associated with the fourth user device unchanged.

3. The method of claim 2, wherein:

the third user device and the first user device are the same user device;

the fourth user device and the second user device are the same user device.

4. The method of claim 1 further comprising:

analyzing the overtaking score associated with the second user device and an overtaking score associated with the first user device;

responsive to both of:

(i) the overtaking score associated with the first user device not exceeding an overtaking threshold;

and (ii) the overtaking score associated with the second user device exceeding the overtaking threshold;

executing:

calculating a traffic flow information for the selected road segment based at least in part on the first movement pattern associated with the first user device and not on the second movement pattern associated with the second user device.

5. The method of claim 4 further comprising:

receiving from a user electronic device a request for the traffic information for the selected road segment;

responsive to the request, transmitting to the user electronic device a trigger configured to cause the user electronic device to display the traffic information for the selected road segment.

6. The method of claim 1, wherein said analyzing the device movement data further comprises:

selecting another road segment from the plurality of road segments traveled;

retrieving at least a third movement pattern associated with a third user device travelling the other road segment and a fourth movement pattern associated with the second user device travelling the other road segment;

comparing the third movement pattern and the fourth movement pattern;

responsive to both of:

(i) the third movement pattern and the fourth movement pattern being indicative of the second user device entering the other road segment later than the third user device entering the selected road segment and leaving the other road segment earlier than the third user device;

and (ii) the third user device and the second user device subsequently entering a same other sequential road segment from the plurality of road segments, the same other sequential road segment being adjacent to the other road segment;

executing:

further incrementing the overtaking score associated with the second user device.

7. The method of claim 1, wherein said analyzing the device movement data further comprises:

selecting another road segment from the plurality of road segments travelled;

retrieving at least a third movement pattern associated with a third user device travelling the other road segment and a fourth movement pattern associated with the second user device travelling the other road segment;

comparing the third movement pattern and the fourth movement pattern;

responsive to both of:

(i) the third movement pattern and the fourth movement pattern being indicative of the third user device entering the other road segment later than the second user device entering the selected road segment and leaving the other road segment earlier than the second user device;

and (ii) the third user device and the second user device subsequently entering a same other sequential road segment from the plurality of road segments, the same other sequential road segment being adjacent to the other road segment;

executing:

decreasing the overtaking score associated with the second user device.

8. The method of claim 1, further comprising defining the plurality of road segments travelled based on a pre-defined segmentation rule.

9. The method of claim 8, wherein the pre-defined segmentation rule is for defining a given road segment having a length of 200 meters.

10. The method of claim 8, wherein the pre-defined segmentation rule is for defining a given road segment being disposed in-between two sequential traffic lights.

11. The method of claim 1, wherein the device movement data further comprises a unique user device identifier associated with an originating user of the device movement data.

12. The method of claim 1, wherein the overtaking score associated with the second user device is used in determining whether to use device movement data associated with the second user device in determining the traffic flow.

13. The method of claim 12, wherein the overtaking score associated with the second user device is instrumental in determining whether to use device movement data associated with the second user device in determining the traffic flow on a going forward basis.

14. The method of claim 13, wherein if the overtaking score is indicative of the second user device having an abnormal driving pattern, the device movement data associated with the second user device is not used in determining the traffic flow for a pre-determined period of future time.

15. The method of claim 13, wherein the abnormal driving pattern is an abnormal overtaking pattern.

16. The method of claim 15, wherein the abnormal overtaking pattern is one of:

the second user device having a number of overtaking maneuvers over a first threshold;

the second user device being overtaken for a number of times over a second threshold.

17. The method of claim 1, wherein the method further comprises generating a movement graph, the movement graph made up of nodes interconnected by shoulders, wherein shoulders represent the at least one road segment traveled and the nodes represent an entry point and an exit point into an associated shoulder.

18. A server for evaluating traffic, the server executing a traffic prediction algorithm, the server being communicatively coupled to an electronic device, the electronic device executing a mapping application for electronically providing to a user of the electronic device the estimated road traffic condition, the server being configured to:

receive from at least two of the plurality of user devices device movement data, the device movement data having been generated by the map application, the device movement data indicative of moving patterns of the at least two of the plurality of user devices, each moving pattern including at least an indication of:

at least one road segment traveled, at least one time record, each one of the at least one time record associated with a respective road segment traveled, the time record indicating an entry time and an exit time for the respective segment traveled;

analyze the device movement data by:

selecting a road segment from the at least one road segment traveled;

retrieving at least a first movement pattern associated with a first user device travelling the selected road segment and a second movement pattern associated with a second user device travelling the selected road segment;

comparing the first movement pattern and the second movement pattern;

responsive to both of:

(i) the first movement pattern and the second movement pattern being indicative of the second user device entering the selected road segment later than the first user device entering the selected road segment and leaving the selected road segment earlier than the first user device;

and (ii) both the first user device and the second user device subsequently entering a same sequential road segment from the plurality of road segments, the same sequential road segment being adjacent to the selected road segment;

executing:

incrementing an overtaking score associated with the second user device.

* * * * *